US005385160A

United States Patent [19]

Brinkman

[11] Patent Number: 5,385,160

[45] Date of Patent: Jan. 31, 1995

[54] GOLF CLUB CLEANER

[76] Inventor: John D. Brinkman, 1268 Holly Dr., Springfield, Ohio 45504

[21] Appl. No.: 92,879

[22] Filed: Jul. 19, 1993

[51] Int. Cl.[6] ..... B08B 3/12

[52] U.S. Cl. ..... 134/186; 134/1

[58] Field of Search ..... 134/1, 184, 186; 15/21.1, 88.2, 88.3; 366/127

[56] References Cited

U.S. PATENT DOCUMENTS 4,676,839 6/1987 Osborn ..... 134/25.4
4,757,831 7/1988 Ingermann et al. ..... 134/148
5,168,888 12/1992 Altnasser ..... 134/181

*Primary Examiner*—Philip R. Coe
*Attorney, Agent, or Firm*—Jacobson, Price, Holman & Stern

[57] ABSTRACT

A golf club cleaner utilizing an ultrasonic energy apparatus associated with a quantity of cleaning solution in a tank in which the club heads or handles are immersed. The cleaning solution tank includes a basket occupying a portion of the tank to support the club heads in a position elevated from the bottom of the tank to restrict the ultrasonic cleaning function to only the club heads and not the club shaft with a peripheral portion of the basket being spaced from a peripheral portion of the tank to enable club handles to be inserted downwardly between the basket and the periphery of the tank into engagement with the bottom surface of the tank in order to subject the entire golf club handle to the ultrasonic cleaning operation. The tank is associated with a supporting cabinet which supports a plurality of clubs when the club heads are being cleaned and when the clubs are inverted for cleaning the handles with the cabinet being provided with apparatus for introducing ultrasonic energy into the cleaning solution, a pump assembly for changing the cleaning solution and a control system for controlling operation of the golf club cleaner.

7 Claims, 2 Drawing Sheets

10
12
14
16
18
2
2
24
50
54

24
30
46
60
56
38
30
28
26
48
16
58
36
32
40
34
42

GOLF CLUB CLEANER

BACKGROUND OF THE INVENTION

1. Field of the Invention

The present invention generally relates to a golf club cleaner utilizing an ultrasonic energy apparatus associated with a quantity of cleaning solution in a tank in which the club heads or handles are immersed. The cleaning solution tank includes a basket occupying a portion of the tank to support the club heads in a position elevated from the bottom of the tank to restrict the ultrasonic cleaning function to only the club heads and not the club shaft with a peripheral portion of the basket being spaced from a peripheral portion of the tank to enable golf club handles to be inserted downwardly between the basket and the periphery of the tank into engagement with the bottom surface of the tank in order to subject the entire golf club handle to the ultrasonic cleaning operation. The tank is associated with a supporting cabinet which supports a plurality of clubs when the club heads are being cleaned and when the clubs are inverted for cleaning the handles with the cabinet being provided with apparatus for introducing ultrasonic energy into the cleaning solution, a pump assembly for changing the cleaning solution and a control system for controlling operation of the golf club cleaner.

2. Description of the Prior Art

Golf club cleaners of various types are well known and include rotating or movable brush types and ultrasonic energy types and ultrasonic energy has been used for various other cleaning purposes. The following U.S. Pat. Nos. disclose golf cleaners and other ultrasonic energy devices relevant to this invention.

3,180,626
3,301,535
3,583,018
4,380,839
4,870,982
5,141,009
3,101,089
3,007,478
3,648,315
3,709,732
4,193,818
4,316,750
4,710,233

U.S. Pat. No. 5,141,009 discloses a golf club cleaning apparatus as does U.S. Pat. No. 3,101,089. However, the prior art does not disclose the specific structural arrangement utilized in this invention including the novel structure in association of the cleaning solution tank and basket by which the club heads can be immersed to a limited depth in the cleaning solution while the handles can be immersed for the full length of the handles with the major length portion of the club shafts not being subjected to immersion in the cleaning solution and not subjected to cleaning by use of ultrasonic energy.

SUMMARY OF THE INVENTION

An object of the present invention is to provide a golf club cleaner utilizing a tank and club head supporting basket containing a quantity of cleaning solution combined with an ultrasonic wave energy device to effectively clean golf club heads and golf club handles.

Another object of the invention is to provide a golf club cleaner in accordance with the preceding object in which the basket is supported from the top edge of the tank or supported in free standing relation on the bottom of the tank with the basket having a depth to receive and support the club heads immersed in the cleaning solution with the depth of the basket limiting the depth of the club heads to a position that the club shafts will not be immersed in the cleaning solution.

A further object of the invention is to provide a golf club cleaner in accordance with the preceding objects in which the width of the basket is less than the width of the open upper end of the tank with the basket being positioned at the forward portion of the tank to enable the handles of inverted golf clubs to be inserted downwardly between the rear wall of the tank and the rear wall of the basket to engage the bottom of the tank thus enabling the handles of the golf club to be completely immersed in the cleaning solution but substantially precluding contact between the club shafts and the cleaning solution.

Still another object of this invention is to provide a golf club cleaner in accordance with the preceding objects in which the golf clubs are supported in an upwardly and slightly rearwardly inclined position by a cabinet structure thus enabling the golf clubs to be supported either with the club heads in the basket or the handles inserting completely into the tank without utilizing supporting or retaining devices which would require manipulation of the clubs and the retaining devices when cleaning the clubs which enables the device to be easily and effectively used by golfers since the cleaner merely requires the golf clubs to be placed in the basket or tank and leaned against a cabinet wall with various types of controls being capable of use in operating and controlling the cleaner.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
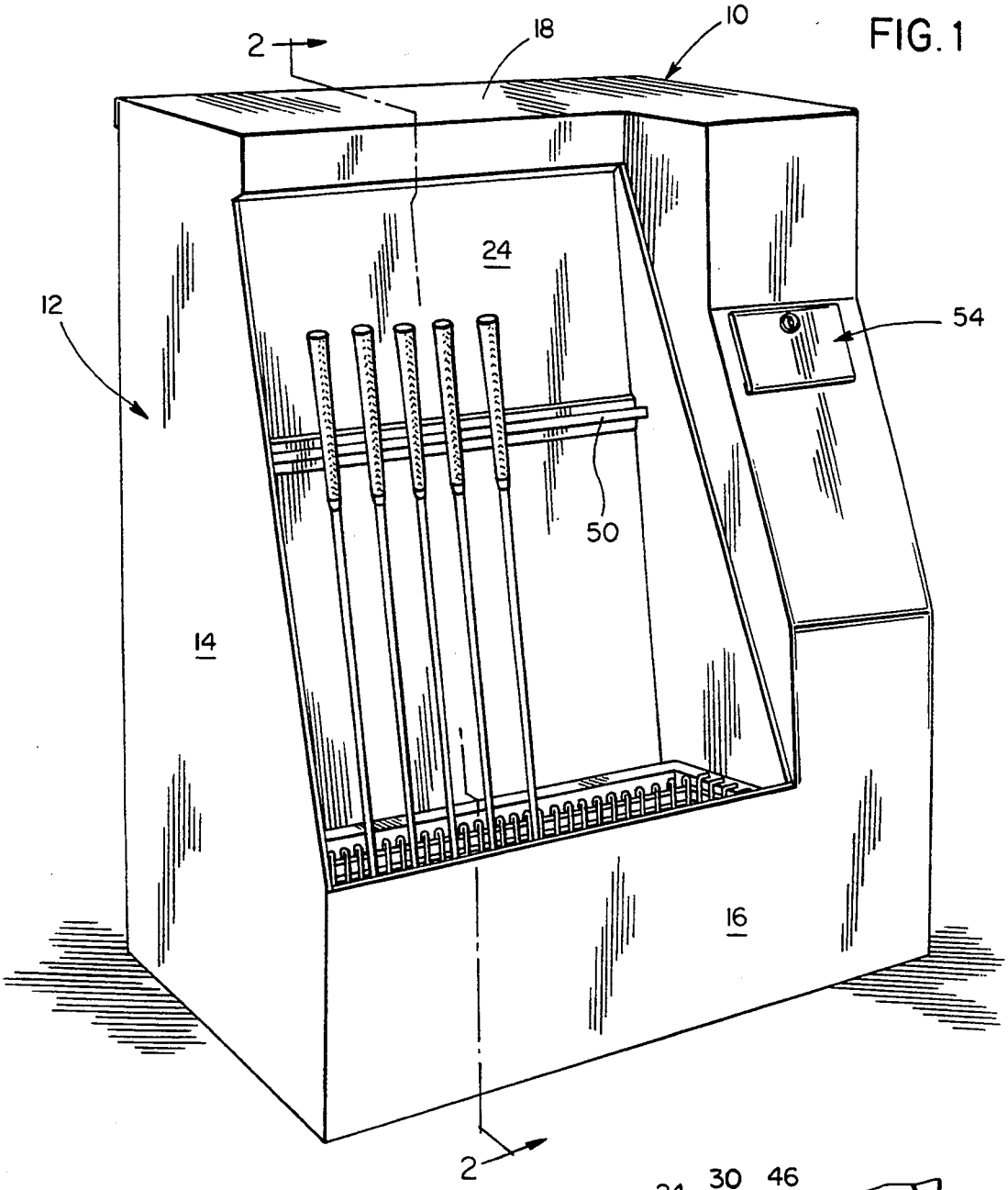
FIG. 1 is a perspective view of the golf club cleaner of the present invention.

Referring now specifically to the drawings, the golf club cleaner of the present invention is generally designated by numeral 10 and includes a vertically upstanding cabinet 12 including side walls 14, a front wall 16, a top wall 18, back wall 20 and an optional bottom wall 22. The front wall 16 includes a rearwardly offset inclined front panel 24. The upper edge portion of the relatively short front wall 16 is provided with a horizontal flange 26 and the bottom edge of the panel 24 is provided with a similar flange 28 in horizontal alignment therewith to supportingly engage a peripheral outwardly projecting flange 30 around the upper end of a generally rectangular open topped tank 32 for receiving a quantity of cleaning solution 34 therein which is filled to a level substantially to the top of the tank but slightly below the top to prevent accidental spillage.

Positioned in the tank 32 is a generally rectangular basket 36 having an open top and constructed of wire mesh or grid material to enable circulation of the cleaning solution 34 through the basket so that the level of the cleaning solution 34 in the basket will be the same as the level of the cleaning solution in the tank. The front and end walls of the basket 36 have a projecting flange 38 which rest upon and are supported from the corresponding top flange 30 on the tank 32 thus enabling the basket to be removed when desired, such as when cleaning the interior of the tank 32. Alternatively, the basket 36 may be supported from the bottom of the tank 32 in a free standing relation by direct contact or by depending legs.

Figure 2:
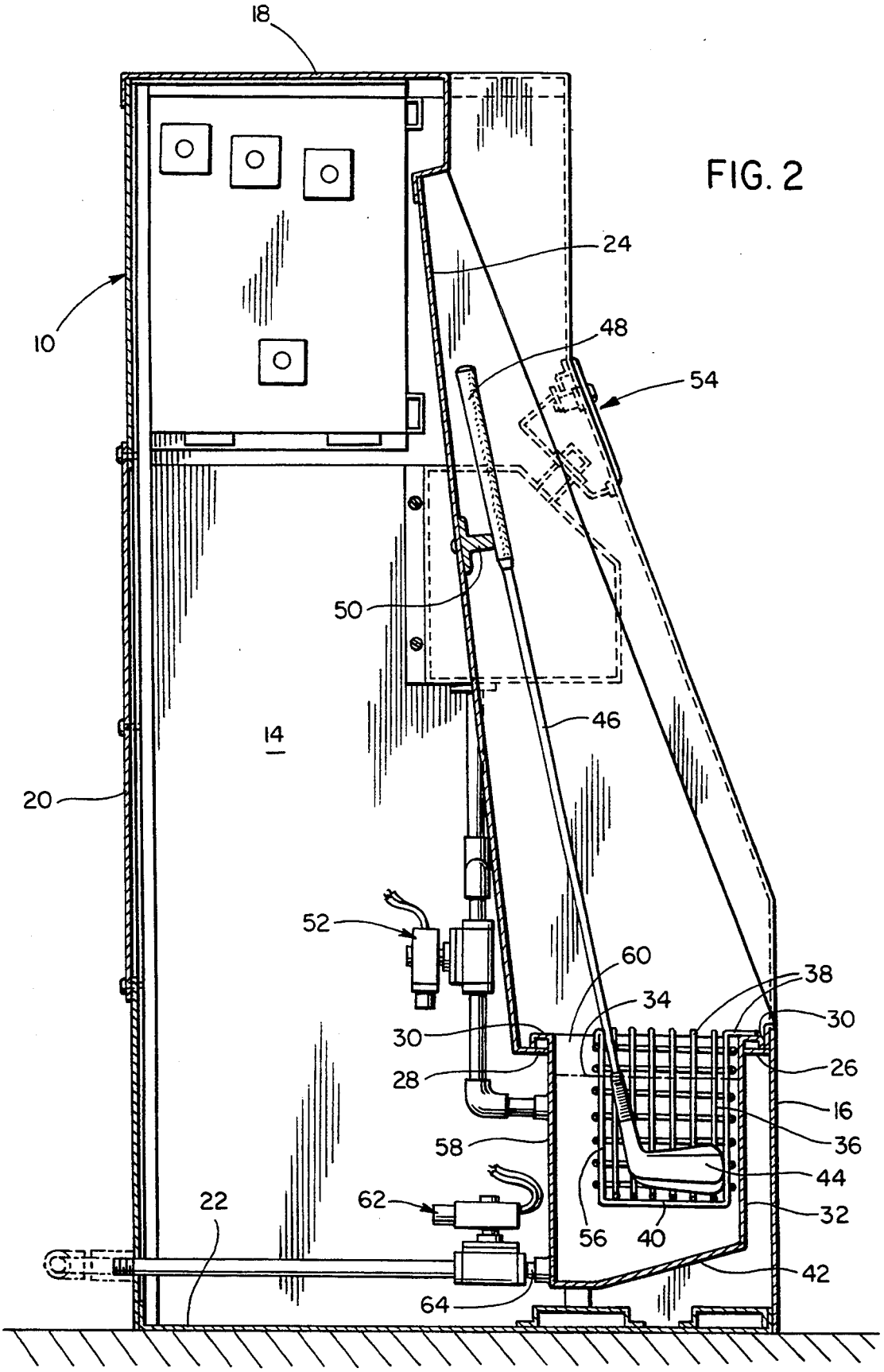
FIG. 2 is a vertical sectional view take along section line 2.2 on FIG. 1 illustrating the structure of the tank and basket to support golf club heads when being cleaned.

As illustrated in FIG. 2, the basket 36 has a bottom wall 40 spaced upwardly from the bottom wall 42 of the tank 32, a distance which is approximately one-third of the height of the tank 32 although this will vary depending upon the height of the tank 32. The basket 36 supports a plurality of club heads 44 in which the club shafts 46 extend upwardly and rearwardly in an inclined position with the handles 48 or adjacent portions of the club shaft 46 resting against a horizontally disposed projection 50 on the panel 24 as illustrated in FIGS. 1 and 2, thus supporting the club heads 44 on the bottom wall 40 with the club heads being immersed in the cleaning solution 34 but with the club shafts 46 not being immersed substantially into the cleaning solution so that the cleaning operation will be restricted to the club head 44 and adjacent hosel. An ultrasonic energy device 52 for imparting ultrasonic wave energy to the cleaning solution is schematically illustrated and, when operative, will cause the cleaning solution to effectively clean the club heads by ultrasonic waves or impulses imparted to the cleaning solution in a manner well known in the art. This will effectively clean the golf club heads with the cleaning solution being one of many formulations to effectively clean golf clubs. Controls 54 for the time cycle of cleaning and the manner of operating and controlling the time cycle of cleaning is incorporated into the cabinet. The control components are those which are conventionally employed in various vending apparatuses.

Figure 3:
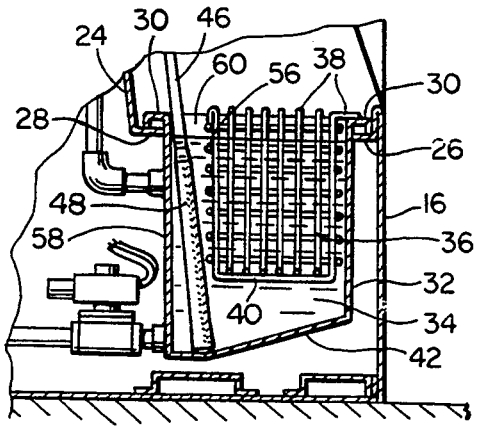
FIG. 3 is a partial sectional view similar to FIG. 2 but illustrating the golf clubs inverted with the handle inserted into engagement with the bottom of the tank.

As illustrated in FIGS. 2 and 3, the basket is constructed with a rear wall 56 that is spaced forwardly from the rear wall 58 of the tank 32 which provides a space 60 into which the handles 46 may be inserted when the golf club is inverted with the handles being inserted downwardly through the space 60 until the handles contact the bottom wall 42 of the tank 32 as illustrated in FIG. 3 with the cleaning cycle being then repeated with the ultrasonic energy device and cleaning solution effectively cleaning the handles or hand grips 48 throughout their length but without substantial immersion of the club shaft 46 into the cleaning solution thereby assuring that the club shaft will not be subjected to any substantial portion of the cleaning operation when the club heads or the club handles or hand grips are being cleaned.

The support or rest 50 enables the clubs to be quickly and easily positioned in the cleaner by merely grasping the handle of the club and inserted the club head into the basket and leaning the handle 48 against the rest 50 thereby eliminating the necessity of manipulating fastening devices or retaining devices. When the cleaning cycle for the club heads has been completed, the club is merely lifted out of the cleaner and the club head dried with a suitable towel and the club is then inverted and the handle or hand grip 48 inserted downwardly into space 60 between the rear wall 56 of the basket and the rear wall 58 of the tank with the end of the handle or hand grip 48 resting against the bottom wall 42 of the tank 32. After the cleaning cycle for the handles 48 has been completed, the golf club is removed and the handle dried with a towel and the clubs placed in a golf bag in a conventional manner.

The ultrasonic golf club cleaner may be used in various locations, such as club house or the like, and may include typical vending machine controls that enables individual golfers to effectively use the cleaner. The cleaner is primarily intended for cleaning metal golf clubs although cleaning wood clubs is possible even though not recommended. The cleaner may be operated by a coin or paper currency control mechanism or the operator of the golf course, driving range or other facility may provide each golfer with an individual code number which can be entered into a keyboard on a control panel on the front upper right portion of the cabinet as indicated at 54. When the code number is entered into the keyboard, an LED display on the control panel will instruct the golfer to load the clubs into the cleaner and push a start bottom which will operate a sonic generator to generate a sonic wave or impulse field in the cleaning solution in the tank with the sonic agitation effectively cleaning the clubs in a relatively short time, such as about 5 minutes, after which the cycle is complete and the LED display will instruct the golfer to remove the clubs and dry them with a towel which may be attached to the cleaner or may be individually provided by the golfer. A pump and drain assembly 62 may be communicated with the lower end of the tank 32 and the bottom wall 42 of the tank may be sloped downwardly toward the rear wall 58 for communication with an outlet 64 associated with a pump and drain assembly 62 to drain and replace the cleaning solution when necessary.

The foregoing is considered as illustrative only of the principles of the invention. Further, since numerous modifications and changes readily will occur to those skilled in the art, it is not desired to limit the invention to the exact construction and operation shown and described, and accordingly, all suitable modifications and equivalence may be resorted to, falling within the scope of the invention.

What is claimed as new is as follows:

1. The golf club cleaner comprising an open topped tank containing a quantity of cleaning solution, means introducing ultrasonic wave energy into said solution, and means in said tank for supporting a portion of a golf club immersed in the cleaning solution and means extending above the tank for supporting a portion of the golf club being cleaned, said means supporting a portion of the golf club including a basket of mesh material positioned in the tank, said tank and basket of mesh material being open topped with the basket including a laterally extending top flange Supported from the open top of the tank, said basket having a vertical depth less than the vertical depth of the tank to support golf club heads above the bottom of the tank but below the level of cleaning solution in the tank with the golf club heads immersed in the solution and the golf club shafts extending above the cleaning solution.

2. The golf club cleaner as defined in claim 1, wherein said basket has a width less than the width of the tank to provide a space between the basket and tank to receive a golf club handle between the exterior of the basket and the interior of the tank, said means supporting the golf club including the bottom of the tank engaged by the golf club handle of an inverted golf club.

3. The golf club cleaner as defined in claim 1, wherein said means supporting portions of golf clubs extending above the tank includes an inclined wall against which the portions of the golf clubs extending above the tank rest by gravity and friction thereby enabling golf clubs to be positioned in the golf club cleaner without manipulation of supporting and retaining devices.

4. The golf club cleaner as defined in claim 3, wherein said inclined panel is a rearwardly offset portion of a front wall of a vertically disposed cabinet, said cabinet including means controlling operation of the ultrasonic wave energy means, and pump and drain means associated with the tank for replacing cleaning solution as required.

5. The golf club cleaner as defined in claim 4, wherein said tank includes a bottom wall inclined toward one edge thereof with the pump and drain means being communicated with the lower most portion of the bottom wall of the tank to facilitate drainage and replacement of the cleaning solution.

6. The golf club cleaner comprising an open topped tank containing a quantity of cleaning solution, means introducing ultrasonic wave energy into said solution, and means in said tank for supporting a portion of a golf club immersed in the cleaning solution and means extending above the tank for supporting a portion of the golf club being cleaned, said means supporting a portion of the golf club including a basket of mesh material positioned in the tank, said tank and basket of mesh material being open topped with the basket supported from the tank, said basket supporting golf club heads above the bottom of the tank but below the level of cleaning solution in the tank with the golf club heads immersed in the solution and the golf club shafts extending above the cleaning solution.

7. The golf club cleaner as defined in claim 6, wherein said basket has a width less than the width of the tank to provide a space between the basket and tank to receive a golf club handle between the exterior of the basket and the interior of the tank, said means supporting the golf club including the bottom of the tank engaged by the golf club handle of an inverted golf club.

* * * * *